US005189822A

United States Patent [19]

Schmanski et al.

[11] Patent Number: 5,189,822

[45] Date of Patent: Mar. 2, 1993

[54] TAMPER RESISTANT SIGN

[75] Inventors: Donald W. Schmanski; Andrew J. Huntington, both of Carson City, Nev.

[73] Assignee: Carsonite International, Carson City, Nev.

[21] Appl. No.: 571,982

[22] Filed: Aug. 24, 1990

[51] Int. Cl.[5] ..... G09F 7/02

[52] U.S. Cl. ..... 40/611; 40/642; 248/551

[58] Field of Search ..... 40/611, 642, 649, 5, 40/201, 202, 152.1, 584; 248/551, 220.2, 297.2, 231.91

[56] References Cited

U.S. PATENT DOCUMENTS

| | | | |
|---|---|---|---|
| 1,421,022 | 6/1922 | Mollet | 40/611 |
| 3,078,608 | 2/1963 | Diack | 40/152.1 |
| 4,300,299 | 11/1981 | Batky et al. | 40/642 |
| 4,583,309 | 4/1986 | Kane et al. | 40/152.1 |
| 4,672,758 | 6/1987 | Le-Carpentier et al. | 40/649 |
| 4,729,183 | 3/1988 | Tarter et al. | 40/642 |
| 4,779,366 | 10/1988 | Jost | 40/649 |
| 4,779,369 | 10/1988 | Hill et al. | 40/642 |

FOREIGN PATENT DOCUMENTS

| | | | |
|---|---|---|---|
| 675078 | 4/1939 | Fed. Rep. of Germany | 40/642 |
| 677120 | 11/1964 | Italy | 40/642 |

*Primary Examiner*—Kenneth J. Dorner
*Assistant Examiner*—Brian K. Green
*Attorney, Agent, or Firm*—Thorpe, North & Western

[57] ABSTRACT

A tamper resistant sign for flush mounting to a wall or substantially flat surface comprises an elongate, one piece, extruded or pultruded frame. The frame has a back wall and a pair of ribs extending backwardly from respective lateral side edges of the back wall. A pair of open sided channels are positioned along the side edges of the frame. The open sides of the channels face each other and have a clear plastic faceplate positioned therebetween, with the opposite lateral sides of the faceplate being received longitudinally within the respective channels. Molded end caps are provided that seat firmly against the back wall and channel of the frame to close the opposite ends of the sign. The end caps fit securely and tightly in the channels and against the back wall of the frame.

8 Claims, 2 Drawing Sheets

TAMPER RESISTANT SIGN

BACKGROUND OF THE INVENTION

Field of the Invention

The present invention relates to signs and especially to route signs used for public transportation.

State of the Art

Route signs are commonly used in public transportation. The signs are usually elongate in nature and provide route information for a particular run or route. The signs are installed in cubicles or stalls on the route, with each sign being affixed to a portion of a wall of a respective cubicle or stall. The signs are often subject to vandalism and malicious tampering, and the cost of replacement and repair is a significant. It would be desirable to provide tamper resistant signs which would reduce the maintenance costs in repairing and replacing the signs due to vandalism. It is also desirable to provide signs which are weather resistant inasmuch as the cubicles or stalls in which they are installed are often open to the elements.

Objectives

A principal objective of the invention is to provide a unique sign for use as a route sign or the like in public transportation systems, wherein the sign is formed of a one piece frame having a novel construction including a back side profile which mounts flush with a wall or other substantially flat support surface, with the back side profile including ribs at the outside edges of the back wall which are formed integrally with channel members at the sides of the sign, whereby the ribs and associated channels form combined structure that very effectively inhibits insertion of a prying element, such as a screwdriver, between the rib and the wall or flat support surface on which the sign is mounted.

Another objective of the present invention is to provide such a sign in which an elongate depression is formed along the central, elongate axis of the back side profile, with the depression forming an elongate projection protruding from the outer surface of the back wall in the same direction as the ribs and to a depth substantially the same as that of the ribs, with the depression having openings therein for fastener elements to attach the sign to the wall or flat support surface on which the sign is mounted.

A still further objective of the present invention is to provide such a sign having novel, molded end caps that seat firmly against the back wall and channel of the frame to close the opposite ends of the sign, with the end caps having tongue inserts that engage outer surfaces of the back wall between the ribs and the elongate projection, whereby the tongue inserts rigidly hold the back edges of the caps to the wall surface to provide exceptional resistance to the insertion of a prying element between the caps and the wall or flat support surface on which the sign is mounted.

An additional objective of the present invention is to provide such a sign having a clear faceplate that is inserted in the channels at the sides of the frame to form a clear front face of the sign, with molded end caps that close the opposite ends of the sign and have front finish plates that extend inwardly from the caps over the end portions of the clear plastic faceplate and between the opposed free edges of the channels at each of the sides of the frame, wherein the free lateral edges of the channels have a convex curvature and the lateral edges of the front finish plates have a concave curvature which matches and interlocks with the convex curvature of the lateral side edges of the channels so as to provide exceptional resistance to the insertion of a prying element between the finish plates and the edges of the channels or the clear plastic faceplate.

BRIEF DESCRIPTION OF THE INVENTION

The above objectives are achieved in accordance with the present invention by providing a novel, tamper resistant sign for flush mounting to a wall or substantially flat surface. The sign comprises an elongate, one piece, extruded or pultruded frame. The frame has a back wall and a pair of relatively narrow ribs extending backwardly from respective lateral side edges of the back wall. Opposite side walls extend forwardly from the respective side edges of the back wall, with the side walls being contiguous with the respective ribs at the respective side edges of the back wall.

A pair of flanges extending toward each other from the forward side edges of the side walls, with the respective flanges, side walls and side edge portions of the back wall forming respective open sided channels along the side edges of the frame. The open sides of the channels face each other and have a clear plastic faceplate positioned therebetween, with the opposite lateral sides of the faceplate being received longitudinally within the respective channels, such that the faceplate forms a clear front face of the sign.

Means are provided for mounting the back wall to a flat support surface to which the sign is to be mounted. The ribs at the opposite side edges of the back wall are held tight and flush against the support surface, with each rib and its associated channel forming a combined structure that very effectively inhibits insertion of a prying element between the rib and the support surface.

An elongate depression is preferably formed along the central, elongate axis of the inside surface of the back wall of the frame. The depression in the inner surface of the back wall forms a corresponding projection protruding from the outer surface of the back wall in the same direction as the ribs. The projection from the back wall has a depth substantially the same as the depth of the ribs at the side edges of the back wall. Openings are formed in the depression for accepting fastener elements used in attaching the sign to the wall or flat support surface on which the sign is mounted.

The sign further preferably includes molded end caps that seat firmly against the back wall and channel of the frame to close the opposite ends of the sign. The end caps fit securely and tightly in the channels and against the back wall of the frame, with the caps further including tongue inserts or tabs extending from the back sides of the caps. The tongue inserts or tabs are essentially flat plate-like projections that fit between the ribs and the elongate projection on the outside surface of the back wall and abut flatwise with the outside surface of the back wall in the area between the ribs and the elongate projection. The tongue inserts form a support tab or plate that is held firmly between the surface on which the sign is mounted and the outside surface of the back wall of the sign. The tabs in turn form a rigid support that holds the back edges of the caps to the surface on which the sign is mounted to provide exceptional resistance against insertion of a prying element between the caps and the surface on which the sign is mounted.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENT

Figure 1:
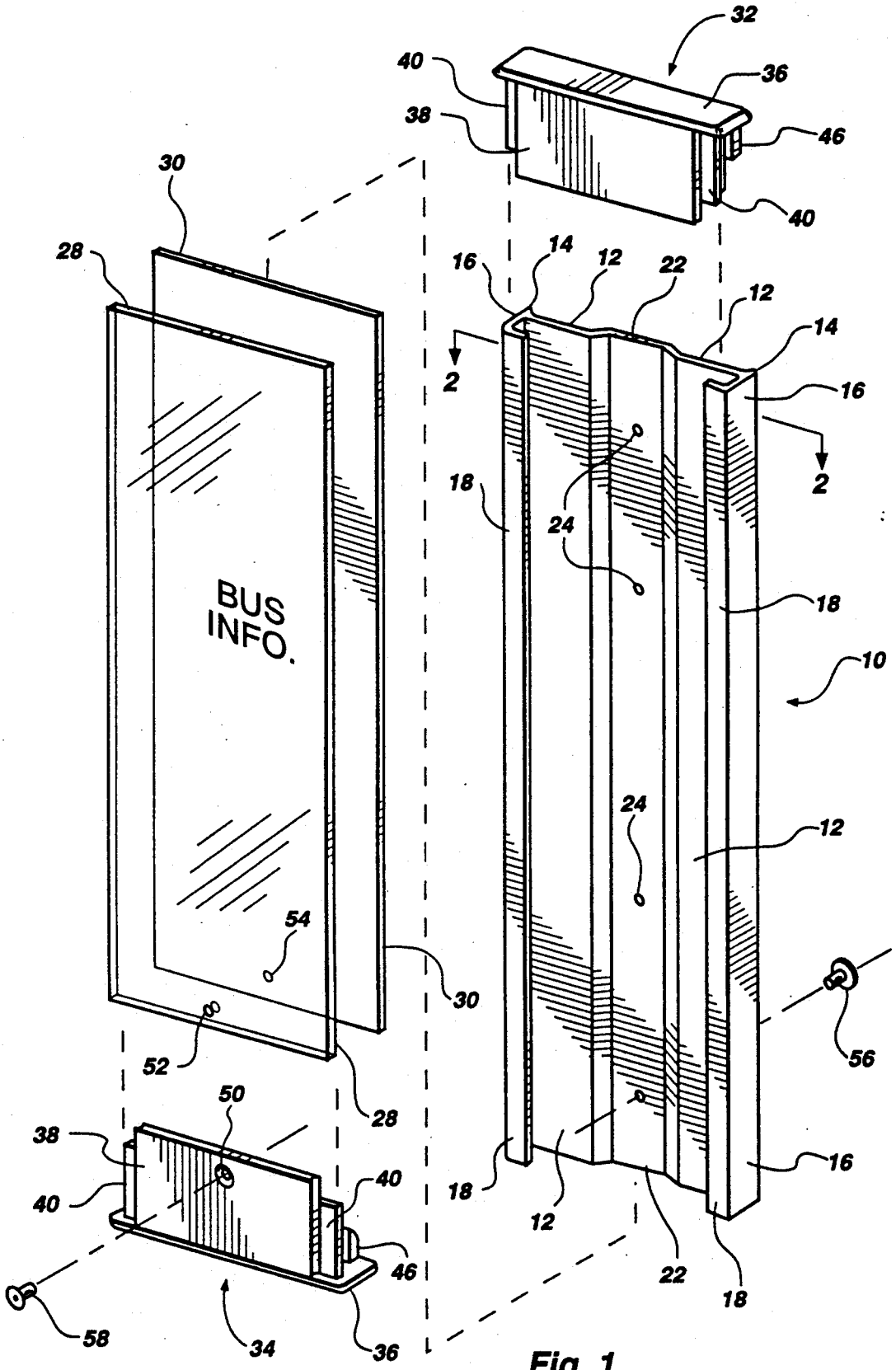
FIG. 1 is an exploded pictorial representation of a sign in accordance with the present invention.

Referring to the drawings, there is shown an elongate sign which is particularly adapted for use as a route and information sign in public transportation facilities. Because of high incidence of vandalism and malicious mischief occurring in such facilities, it is advantageous to provide an elongate, tamper resistant sign for flush mounting to a support wall of the facilities.

The sign of the present invention comprises a single piece, unitary frame 10 having an elongate, extruded or pultruded back wall 12. A pair of relatively narrow ribs 14 extend backwardly from respective lateral side edges of the back wall 12, and a pair of opposite side walls 16 extend forwardly from the respective side edges of the back wall 12. The side walls 16 are contiguous with the respective ribs 14 at the respective side edges of the back wall 12 and are formed integrally with the ribs 14 and back wall 12. A pair of flanges 18 extend from the forward side edges of the side walls 16, with the flanges 18 directed toward each other so that the respective flanges 18, side walls 16 and side edge portions of the back wall 12 form channels positioned along the side edges of the back wall 12. The channels have inwardly facing, open sides that face each other. The total unitary frame structure 10 is formed of fiber reinforced thermosetting resin by a well known process referred to as pultrusion.

Means are provided for mounting the back wall 12 to the support wall 20 so that the ribs 14 at the opposite side edges of the back wall 12 are held tight and flush against the support wall 20. Each rib 14 and the sidewall 16 associated therewith form a combined structure that is highly effective in inhibiting insertion of a prying element, such as a screwdriver, between the rib 14 and the support wall 20.

In the tamper resistant sign of the present invention as illustrated, an elongate depression or trough 22 is preferably formed along the central elongate axis of the back wall 12, with the depression or trough 22 depressed backwardly from the forward face of the back wall 12, so that the trough 22 projects backward from the back side of the back wall 12 to a depth substantially the same as the distance that the pair of ribs 14 extend from the lateral side edges of the back wall 12. The means for mounting the back wall 12 and thus the sign to the support wall 20 comprises openings 24 in the depression or trough 22, with fastener elements, such as the bolt 26 shown in FIG. 2, extending through the openings 24 to engage the support wall 20.

The front of the sign is formed by a clear, protective, plastic panel 28 received within the channels at the sides of the frame of the sign. The clear panel 28 fits snugly within the opposed channels and is held in place at the ends by end caps as will be described further hereinafter. The clear panel 28 is preferably made of a tough material such as polycarbonate polymer so as to withstand rough treatment without damage or breakage.

Display graphics in the form of schedules and other route information are provided on the surface of an insert panel 30 which lies between the back wall 12 and the protective panel 28. The display graphics are visible through the clear protective panel 28. The insert panel 30 fits snugly within the opposed channels and is held in place at its ends by the end caps as will be described hereinafter. The panel 30 is preferably made of a weather resistant polymer.

End caps 32 and 34 are provided at each of the opposite ends of the frame 10 to close the channels, form closed ends of the sign and hold the clear front panel 28 and insert panel 30. An upper end cap 32 fits within the channels to close the upper ends of the channels and thus prevent withdrawal of the insert panel 30 and the clear protective panel 28 from the upper ends of the channels, and a lower end cap 34 fits within the channels to close the lower ends of the channels and thus prevent withdrawal of the insert panel 30 and the clear protective panel 28 from the lower ends of the channels.

Each of the end caps is similar and will be described using the same reference numerals to identify like components of the caps. Each of the end caps comprise a cap plate 36 having dimensions to completely cover the respective upper or lower ends of the sign, including the ends of the back wall 12, the ends of the channels and the ends of the ribs 14. As mentioned previously, the end caps form closed, finished ends of the sign and as will become evident from the remainder of this disclosure, the closed end caps are strong and exhibit exceptional resistance to being pried or otherwise removed from the sign.

Front plates 38 extend upwardly and downwardly from respective front side edges of the cap plates 36 of the respective upper and lower end caps 34 and 36. The front plates 38 slide downwardly from the upper end cap 32 and upwardly from the lower end cap 34 to respective operative positions between the lateral edges of the pair of flanges 18 which form the channels at the longitudinal sides of the sign.

A pair of fins 40 are connected to the back face of each front plate 38 and extend from the opposite lateral sides of the plate 38 toward the respective side walls 16. The fins 40 engage inner facing side edges or surfaces of the pair of flanges 18 when the plate 38 slides to its operative position. At least one projection 42 (four such projections 42 being included in the preferred embodiment illustrated in the drawings) extend from the back of each of the front plates 38 to engage the back wall 12 of the frame 10 when the plates 38 slide to their operative positions.

The fins 40 and projections 42 fit snugly against the flanges 18 and back wall 12 to effectively form frictional wedges that are held in place between the flanges 18 and the back wall 12. A bonding agent is preferably used to bond the fins 40 and projections 42 of the upper end cap 32 to the flanges 18 and back wall 12 to lock the upper end cap 32 in place. The lower end cap 34 is releasably locked in place by a retaining fastener as will be described more fully hereinafter.

Figure 3:
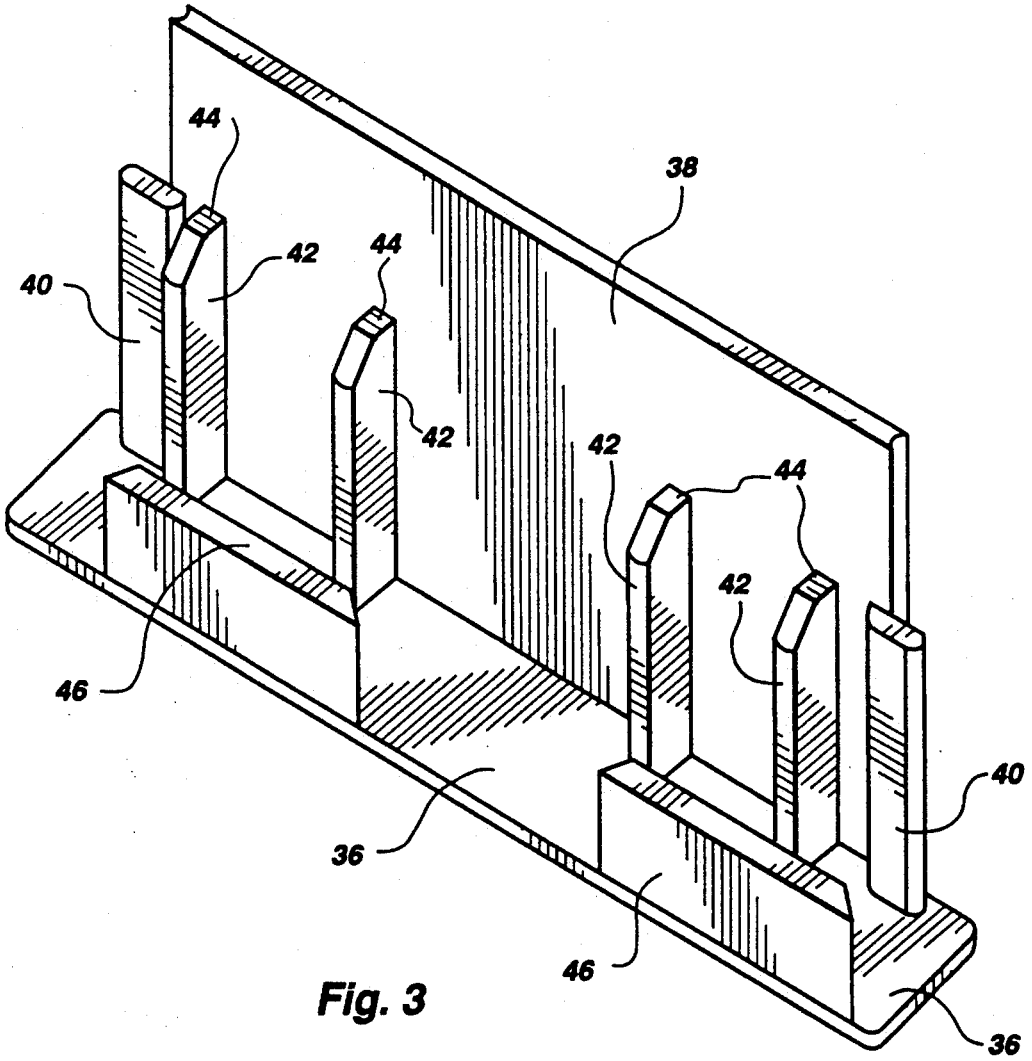
FIG. 3 is pictorial view of the reverse side of one of the cap members of the sign of FIG. 1.

The fins 40 and projections 42 comprise elongate ribs extending from the back of the front plates 38 of the cap members 32 and 34, with the ribs having uniform lengths which are less than the distance that the front plates 38 extend from the cap plates 36. The ends of the fins 40 and projections 42 remote from the cap plates 36 form abutments 44 as shown in FIG. 3. These abutments 44 on the opposite end caps 32 and 34 engage the respective ends of the clear front panel 28 and the insert panel 30 to hold those panels firmly against lateral movement within the channels of the frame 10.

The front plates 38 of the end caps 32 and 34 extend over the opposite end portions of the clear front panel 28 and cover the ends of the panel 28 and the intersections of the ends of the panel 28 with the abutments 44. The front panel 28 is thus firmly held in place in the sign and there are no edges or sides of the front panel 28 exposed. Exposed edges would otherwise be prone to the action of a prying tool, such as a screwdriver, to force the front panel 28 from the frame 10. With no such exposed edges, the front panel 28 is virtually immune from being pried away from the frame 10 of the sign.

The end caps 32 and 34 further preferably comprise a pair of back plates 46 extending upwardly and downwardly from respective back side edges of the cap plates 36 of the end caps 32 and 34, with the back plates 46 sliding along the back side of the back wall 12 between the respective ribs 14 at the lateral edges of the back wall 12 and the depression or trough 22 protruding backwardly from the back wall 12. As mentioned previously, the back plates 46 form tongue inserts that fit between the ribs 14 and the elongate depression or trough 22 on the outside surface of the back wall 12 to abut flatwise with the outside surface of the back wall 12 in the area between the ribs 14 and the elongate depression or trough 22. The tongue inserts, i.e., the back plates 46, form a support tab or plate that is held firmly between the surface on which the sign is mounted and the outside surface of the back wall 12 of the sign. The tabs, i.e., back plates 46, in turn form a rigid support that holds the back edges of the caps 32 and 34 to the surface on which the sign is mounted to provide exceptional resistance against insertion of a prying element between the caps 32 and 34 and the surface on which the sign is mounted.

Figure 2:
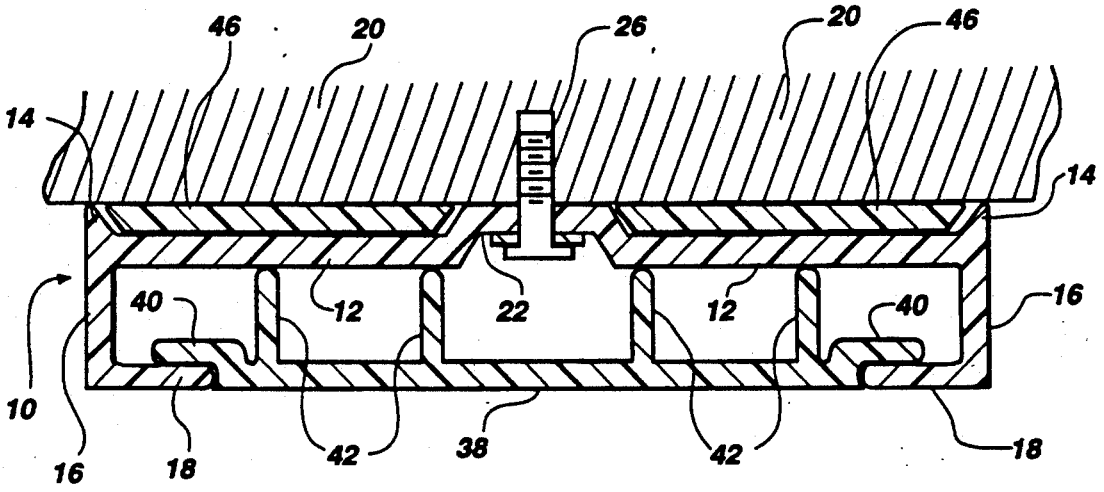
FIG. 2 is a cross section through the sign of FIG. 1 in its assembled condition, taken on line 2—2 of FIG. 1.

In a preferred embodiment of the invention, the lateral edges of the pair of flanges 18 have a convex curvature as best shown in FIG. 2. Further, the lateral edges of the front plates 38 of the end caps 32 and 34 have a concave curvature which matches and receives the convex curvature of the lateral edges of the flanges therein. This forms an interlock between the flanges 18 and the edges of the front plates 38 of the end caps 32 and 34. This interlocking strengthens the front plates 38 and provides exceptional resistance to the insertion of a prying tool, such as a screwdriver, between the flanges 18 and the front plates 38.

The depression or trough 22 in the back wall 12 of the frame 10 has several functions. The trough 22 adds rigidity and strength to the back wall 12, and provides a depression for housing the heads of the fasteners 26 used in mounting the sign to its support wall 20. The insert panel 30 and clear front panel 28 are easily inserted into the frame 10 by sliding freely over the back wall 12 with no interference from the heads of the fasteners 26. Further, the slots formed at the back side of the back wall 12 between the ribs 14 and depression 22 are highly advantageous for receiving the tabs or tongues 46 on the back sides of the end caps 32 and 34 as explained above.

As mentioned previously, the upper end cap 32 is preferably bonded permanently in place by a bonding agent. It is not advantageous to permanently bond the lower end cap 34 in place inasmuch as it is often necessary to access the insert panel 30 in the sign to change or add information shown thereon. To achieve such access, means are preferably provided for releasably mounting the lower end cap 34 to the sign. Such means, as illustrated in FIG. 1 of the drawings, comprises a countersunk opening 50 in the front plate 38 of the lower end cap 34. Corresponding openings 52 and 54 are provided in the clear face panel 28 and insert panel 30, respectively. A mounting element 56 having a threaded opening therein is provided in the back wall 12, with the threaded opening in the mounting element 56 being in alignment with the countersunk opening 50 in the front plate 38. A threaded fastener 58 extends through the countersunk opening 50 and is threaded in the threaded opening of the mounting element 56. The fastener 58 is made tamper resistant by any suitable means known in the art.

The frame 10, including the back wall 12, the pair of narrow ribs 14, the opposite side walls 16, and the pair of flanges 18 are preferably extruded as a unitary piece. The unitary piece is preferably extruded from fiber reinforced polymer. The end caps 32 and 34 are preferably molded as unitry pieces from a thermoplastic polymer.

Although a preferred embodiment of the sign of the present invention has been illustrated and described, it is to be understood that the present disclosure is made by way of example and that various other embodiments are possible without departing from the subject matter coming within the scope of the following claims, which subject matter is regarded as the invention.

We claim:

1. An elongate, tamper resistant sign for flush mounting to a support wall, said sign comprising:

an elongate, sturdy back wall having a central elongate axis, and including top and bottom ends and respective lateral side edges;

a pair of ribs extending backwardly from the respective lateral side edges of said back wall;

opposite side walls including forward side edges and extending forwardly from the respective side edges of said back wall, with said side walls being contiguous with the respective ribs at the respective side edges of said back wall;

a pair of flanges including lateral edges and extending toward each other from the forward side edges of said side walls so that the respective flanges, side walls, and side edge portions of said back wall form respective channels along the side edges of said back wall, with said channels facing each other and including upper and lower ends;

means for mounting the back wall to said support wall such that the ribs at the respective lateral side edges of said back wall are held tight and flush against said support wall, with each rib and associated sidewall forming a combined structure that inhibits insertion of a prying element between the rib and the support wall;

an elongate depression formed along the central elongate axis of said back wall, with the depression protruding backwardly from said back wall to a depth substantially the same as the distance that said pair of ribs extend from the lateral side edges of said back wall;

wherein said means for mounting the back wall to said support wall comprises openings in said depression and fastener elements extending through said openings to engage said support wall;

an insert panel received within the channels and lying adjacent to the back wall;

display graphics formed on the surface of said insert panel which faces away from said back wall;

a clear protective panel received within the channels to overlie the insert panel;

an upper end cap, a portion of which fits within the channels to close the upper ends of the channels and thus prevent withdrawal of said insert panel and said clear protective panel from the upper ends of said channels; and a lower end cap which fits within the channels to close the lower ends of the channels and thus prevent withdrawal of said insert panel and said clear protective panel from the lower ends of said channels;

wherein the upper end cap comprises a cap plate including front and back side edges and having dimensions to completely cover the top end of the back wall, the ends of the channels and ends of the ribs;

a front plate having front and back faces and opposite lateral sides and extending downwardly from the front side edge of said cap plate, said front plate sliding downwardly to its operative position between the lateral edges of the pair of flanges which form said channels;

a pair of fins connected to the back face of the front plate and extending from the opposite lateral sides of said front plate toward the respective side walls, with the fins engaging said pair of flanges when the front plate slides downwardly to its operative position;

at least one projection extending from the back face of the front plate to engage said back wall when the front plate slides downwardly to its operative position; and a pair of back plates extending downwardly from the back side edge of said cap plate, said back plates sliding downwardly along said back wall between the respective ribs at the lateral edges of said back wall and the depression protruding backwardly from said back wall.

2. A tamper resistant sign in accordance with claim 1, wherein four projections extend from the back face of the front plate to engage said back wall when the front plate slides downwardly to its operative position.

3. A tamper resistant sign in accordance with claim 1, wherein the lateral edges of the pair of flanges have a convex curvature; and the lateral sides of said front plate have a concave curvature which matches and receives the convex curvature of said lateral edges of the flanges therein.

4. A tamper resistant sign in accordance with claim 1, wherein the upper cap is bonded to the channels and back plate by a bonding agent.

5. An elongate, tamper resistant sign for flush mounting to a support wall, said sign comprising:

an elongate, sturdy back wall having a central elongate axis, and including top and bottom ends and respective lateral side edges;

a pair of ribs ex tending backwardly from the respective lateral side edges of said back wall;

opposite side walls including forward side edges and extending forwardly from the respective side edges of said back wall, with said side walls being contiguous with the respective ribs at the respective side edges of said back wall;

a pair of flanges including lateral edges and extending toward each other from the forward side edges of said side walls so that the respective flanges, side walls and side edge portions of said back wall form respective channels along the side edges of said back wall, with said channels facing each other and including upper and lower ends;

means for mounting the back wall to said support wall such that the ribs at the respective lateral side edges of said back wall are held tight and flush against said support wall, with each rib and associated sidewall forming a combined structure that inhibits insertion of a prying element between the rib and the support wall;

an elongate depression formed along the central elongate axis of said back wall, with the depression protruding backwardly from said back wall to a depth substantially the same as the distance that said pair of ribs extend from the lateral side edges of said back wall;

wherein said means for mounting the back wall to said support wall comprises openings in said depression and fastener elements extending through said openings to engage said support wall;

an insert panel received within the channels and lying adjacent to the back wall;

display graphics formed on the surface of said insert pane which faces away from said back wall;

a clear protective panel received within the channels to overlie the insert panel;

an upper end cap, a portion of which fits within the channels to close the upper ends of the channels and thus prevent withdrawal of said insert panel and said clear protective panel from the upper ends of said channels; and a lower end cap which fits within the channels to close the lower ends of the channels and thus prevent withdrawal of said insert panel and said clear protective panel from the lower ends of said channels;

wherein the lower end cap comprises a cap plate having front and back side edges and having dimensions to completely cover the bottom end of the back wall, the ends of the channels and the ends of the ribs;

a front plate having front and back faces and opposite lateral sides and extending upwardly from the front side edge of said cap plate, said front plate sliding upwardly to its operative position between the lateral edges of the pair of flanges which form said channels;

a pair of fins connected to the back face of the front plate and extending from the opposite lateral sides of said front plate toward the respective side walls, with the fins engaging said pair of flanges when the front plate slides upwardly to its operative position;

at least one projection extending from the back face of the front plate to engage said back wall when the front plate slides upwardly to its operative position; and a pair of back plates extending upwardly from the back side edges of said cap plate, said back plates sliding upwardly along said back wall between the respective ribs at the lateral edges of said back wall and the depression protruding backwardly from said back wall.

6. A tamper resistant sign in accordance with claim 5, wherein four projections extend from the back face of the front plate to engage said back wall when the front plate slides upwardly to its operative position.

7. A tamper resistant sign in accordance with claim 5, wherein the lateral edges of the pair of flanges have a convex curvature; and the lateral sides of said front plate have a concave curvature which matches and receives the convex curvature of said lateral, edges of the flanges therein.

8. A tamper resistant sign in accordance with claim 5, wherein a countersunk opening is provided in the front plate;

a mounting element having a threaded opening is provided at said back wall, with the threaded opening in alignment with the countersunk opening in the front plate; and a threaded fastener extends through the countersunk opening and is threaded in the threaded opening of the mounting element.

* * * * *